United States Patent [19]

Callahan

[11] 4,235,459

[45] Nov. 25, 1980

[54] MARKING SYSTEM

[76] Inventor: Dennis Callahan, 316 Burnside St., Apt. 207, Annapolis, Md. 21403

[21] Appl. No.: 915,816

[22] Filed: Jun. 15, 1978

[51] Int. Cl.[3] ..... B42D 15/00; B42F 21/06; G09F 3/10; G09F 7/12

[52] U.S. Cl. ..... 283/7; 40/2 R; 40/2 A; 40/594; 156/234; 283/19; 283/20; 283/21; 428/42; 428/43; 428/195; 428/211; 428/914

[58] Field of Search ..... 40/2 A, 330, 360, 124.4, 40/125 A, 2 R, 158 R, 594; 156/234, 240; 283/7, 9 A, 11, 36, 37, 39, 41, 18–21; 428/43, 195, 202, 211, 914, 40–42; 35/35 A, 38; 229/92.8

[56] References Cited

U.S. PATENT DOCUMENTS

| | | | |
|---|---|---|---|
| 1,546,831 | 7/1925 | Fritz | 35/35 A |
| 1,601,018 | 9/1926 | Haynes | 40/121 X |
| 3,667,139 | 6/1972 | Barr | 35/38 |
| 3,680,229 | 8/1972 | Serrie et al. | 283/38 X |
| 3,837,100 | 9/1974 | Guida | 40/2 |
| 4,028,826 | 6/1977 | Brandifino et al. | 40/110 |

*Primary Examiner*—Bruce H. Hess
*Attorney, Agent, or Firm*—Scrivener, Parker, Scrivener and Clarke

[57] ABSTRACT

A marking system wherein distinctive, adhesive-backed separable markers are carried on a substrate, and printed on the substrate are images of the respective markers with a blank line being printed adjacent each image on which objects marked may be recorded. The system is particularly, though not exclusively, suited to the marking of keys.

1 Claim, 4 Drawing Figures

FIG. 1.
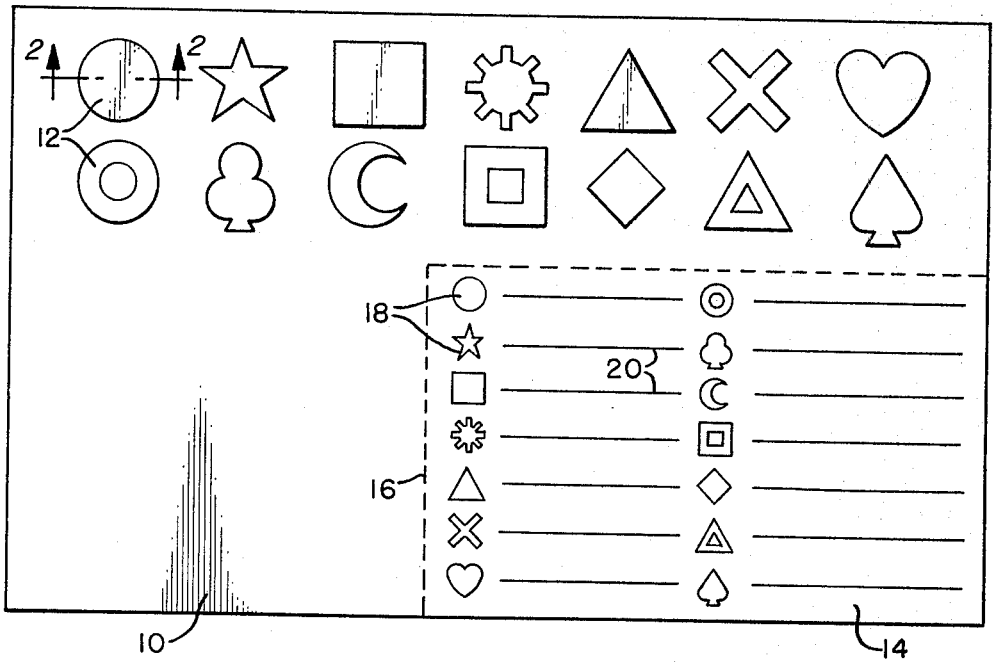
FIG. 2.
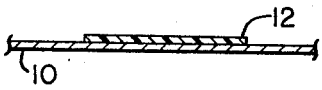
FIG. 3.
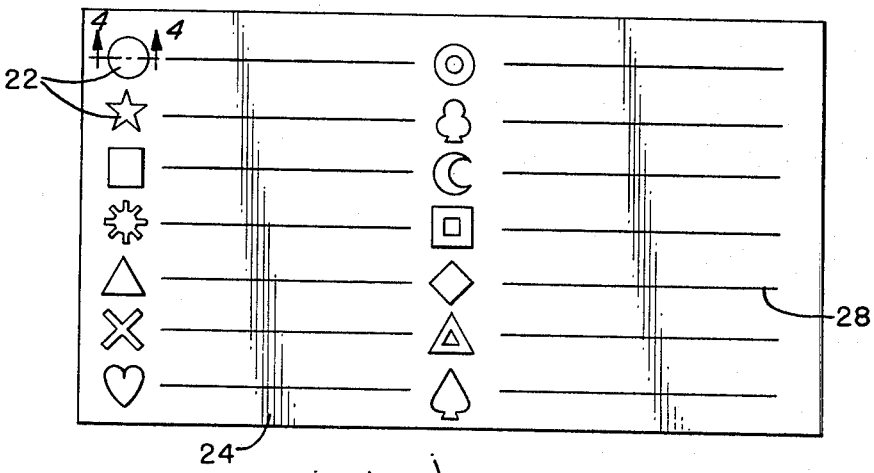
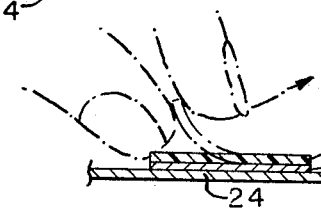
FIG. 4.

MARKING SYSTEM

This invention relates to marking systems and more particularly to a marking system which is especially, though not exclusively, suited to the marking of keys.

Though it will be apparent that the invention has a plurality of uses, it will be described primarily in its application to the marking of keys. Where one carries on a key ring a large number of keys, many of which are almost indistinguishable from others on the same ring, it is an annoying and time consuming exercise to have to try a number of keys in a lock before the correct one is found. To mark each key with an adhesive label bearing the name of the door lock for that key, e.g., "front door", is dangerous because it tells a finder of the key ring, should it be mislaid or otherwise separated from the owner, which door each key opens. One could, of course, put numbered adhesive labels on keys but this is unsatisfactory unless one has a record of which doors the numbers refer to. Making and keeping such a record is inconvenient, and all too often the most used and most important key receives the lowest number, a fact recognized by a finder inclined to use the keys for illegal entry.

The object of the present invention is to provide a system for marking objects, particularly keys, wherein a plurality of adhesive backed markers, each distinctly different, for example, a different shape or color, are releasably carried on a substrate, which also carries the image of each marker printed on the substrate adjacent a blank line on which one can record the particular object marked by that particular marker.

A more specific object of the invention is to provide a system of the foregoing nature wherein each separable marker may be mounted on the substrate overlying its printed image adjacent a blank line for noting the object to which the marker has been applied.

Yet another object of the invention is to provide a system of the foregoing nature wherein the printed images and blank lines are applied to a card portion attached by perforations to the substrate on which the markers are detachably carried outside the perimeter of the card portion.

Still another object of the invention is to provide a system of the foregoing nature wherein the markers have distinctive shapes so that when used on keys, a user can distinguish one key from another by feel provided, of course, he has previously memorized which shapes have been applied to particular keys.

The foregoing and other objects will become apparent as the following detailed description is read in conjunction with the accompanying drawings wherein:

FIG. 1 is a plan view of one embodiment of the marking system of the present invention;

FIG. 2 is an enlarged vertical cross-section view taken substantially on the line 2—2 of FIG. 1;

FIG. 3 is a plan view of a second embodiment of the invention; and

FIG. 4 is an enlarged detailed view taken substantially on the line 4—4 of FIG. 3.

Referring now to the drawings, and particularly FIGS. 1 and 2, the numeral 10 designates a substrate, which may be heavy cardboard or similar sheet material preferably having a waxy or other coating on its front face to define a parting surface for adhesive-backed markers 12, each of which is preferably of a distinctly different shape from the others and of sufficient thickness that when applied to certain objects, as for example, keys, the outlines of one marker can be distinguished merely by feel from the outline of another, thereby rendering an object to which the marker is applied identifiable in the dark.

Instead of different shapes, the markers might be of uniform shape and of different colors, or the markers might be a combination of different shapes and colors, though the different shapes are preferred.

The adhesive employed for the markers may be conventional and of the pressure sensitive type wherein, after removal of a protective strip coated with parting material, the marker may be applied with pressure to an object to be marked, it being thereafter difficult, if not impossible, to remove the marker without tearing it or, if the marker is applied to a fiber surface such as paper or cardboard, without removing a layer of the fiber surface when an attempt is made to remove the marker from the object marked. In the case of the present invention, instead of a protective strip applied to the adhesive surface of a marker, a parting coating on the substrate can serve the identical purpose with the substrate providing a ready means for displaying the system at a point of sale, as for example, on a counter near a cash register where such items as key rings are frequently displayed for sale.

In the embodiment of FIG. 1, a portion 14 of the substrate 10 is preferably wallet sized and joined to the remainder of the substrate by perforations 16. Printed on the portion 14 are images 18 of the respective markers 12, the former matching the latter identically in shape and color, although the size of the printed images may differ from that of the actual markers as may be convenient. Adjacent each of the printed images is printed a blank line 20.

In use, a purchaser separates the markers from the substrate and applies them to the separate articles which are to be marked, for example, to each key on his key ring. He notes on the line opposite each printed image of the marker on the card portion, the object to which the corresponding marker has been applied, and thereafter he separates the card portion 14 from the remainder of the substrate by tearing along the perforation 16. If the objects marked are keys on a ring, the card may be transferred to a wallet where the card can be carried by the user safely separated from the key ring yet the card can be readily referred to whenever the user needs to refresh his recollection as to which door or lock is controlled by which marked key.

It can be seen that by the use of distinctive markers which are totally ambiguous so far as priority of importance of the marked object is concerned, when the markers are applied to keys on a key ring, should the ring be lost or stolen, the finder or stealer will have no clue from the markers themselves as to what doors or locks the keys are to be used with, nor will he be able to deduce which key is likely to be usable with a particular door, even if the finder does have an idea as to the general area of use of the key.

Where the embodiment of FIG. 1 is used, it should be understood that the substrate could extend above the markers and carry suitable advertising matter, directions for use, etc. Obviously the card portion 14 need not be wallet sized but can be any size convenient for record keeping purposes.

The embodiment of FIGS. 3 and 4 is substantially the same as that of FIG. 1 except that instead of the markers being carried on the substrate separately from the printed images, the markers 22 are carried by a substrate 24 over and in registration with their corresponding printed images 26, as can be seen in FIG. 4. Again, blank lines 28 are printed adjacent each printed image.

The card 24 may be wallet or any other convenient size and may be connected by perforations to a larger substrate as in FIG. 1, or it may be sold as a unit substantially as shown in FIG. 3. Should the parting coating on the substrate in either of the embodiments be of the type which would be difficult to write on, the coating may be restricted to areas occupied by the markers and clear of the areas occupied by the printed lines. Obviously, the markers could be mounted in a position to one side of the printed images, if this is convenient, and the images can be applied by any suitable technique, e.g., embossment, and such techniques are intended to be embraced in the specification and claims within the terms "printed" or "printing".

A significant advantage of the marking system of the invention is that it provides a ready means for noting which object has received a particular marker, with this being easily noted at the time the object is marked. In any makeshift system employing adhesive labels, not only must the latter be marked with distinguishable indicia such as numbers, but these indicia must be separately noted on a list which often is not readily available. In the present arrangement, because the marker images are already printed in a position closely associated with the markers and with means for noting the use of each marker, a highly efficient marking system is provided which heretofore has been unavailable.

It will be apparent from the foregoing description that the invention is susceptible of a variety of modifications and changes without, however, departing from the scope and spirit of the appended claims.

What is claimed is:

1. A system for marking a plurality of separate objects comprising a substrate separate from the objects to be marked, a plurality of distinctly different, adhesive backed, markers separably adhered to the substrate, an image of each of said markers being printed on the same substrate to which the markers are adhered, a blank line printed on said substrate adjacent each of the printed images for noting the object to which the corresponding separable marker has been applied following its separation from said substrate and application to said object, each of said markers and its printed image having a shape which is distinctly different from the shape of each of the other markers and its printed image, and each of said markers having sufficient thickness to enable distinguishing by feel the shape of one marker from another when each is applied to a different article, said substrate including a separable card portion, said printed images and blank lines being on the separable card portion, and the separable markers being carried on the substrate outside the perimeter of said card portion.

* * * * *